United States Patent [19]

Foster

[11] Patent Number: 4,969,221

[45] Date of Patent: Nov. 13, 1990

[54] LIFTING AND LOWERING APPARATUS

[76] Inventor: Edson E. Foster, 701 Auqi Esta Dr., Punta Gorda, Fla. 33950

[21] Appl. No.: 435,265

[22] Filed: Nov. 13, 1989

[51] Int. Cl.[5] ..... A61G 7/10

[52] U.S. Cl. ..... 5/81 R; 5/83; 297/DIG. 10

[58] Field of Search ..... 5/81 R, 83, 84, 503, 5/507, 508; 297/DIG. 10

[56] References Cited

U.S. PATENT DOCUMENTS

| | | | |
|---|---|---|---|
| 783,699 | 2/1905 | Laffin . | |
| 1,349,674 | 8/1920 | Jenkins . | |
| 2,498,853 | 2/1950 | Hassold et al. . | |
| 2,542,963 | 2/1951 | Knox et al. . | |
| 2,673,987 | 4/1954 | Upshaw et al. . | |
| 2,975,435 | 3/1961 | Forrest | 5/507 |
| 3,403,411 | 10/1968 | Steinemann et al. . | |
| 3,553,746 | 1/1971 | Seiger | 5/503 |
| 3,806,194 | 9/1974 | Kolebaba | 5/83 X |
| 3,914,806 | 10/1974 | Pearce . | |
| 4,453,766 | 6/1984 | DiVito . | |
| 4,587,678 | 5/1986 | Love et al. . | |
| 4,802,542 | 2/1989 | Houston et al. | 297/DIG. 10 X |

OTHER PUBLICATIONS

Product Brochure: Power Toilet Elevator of Med/West Div. of Western Mfg. Corp, Marshalltown, Iowa 50158 4/87.

*Primary Examiner*—Michael F. Trettel

*Attorney, Agent, or Firm*—Rhodes, Coats & Bennett

[57] ABSTRACT

This invention relates to a lifting and lowering apparatus, and more particularly to such an apparatus useful to persons experiencing difficulty in arising from bed. The apparatus has a base frame for resting on a supporting surface such as a floor, a person supporting platform for engaging the thighs and buttocks of a user of the apparatus, and pivot and lifting devices coupling the platform and the base frame for free rotation of said platform means about a horizontal axis and for powered lifting and lowering of the platform relative to the base frame.

14 Claims, 2 Drawing Sheets

LIFTING AND LOWERING APPARATUS

FIELD AND BACKGROUND OF INVENTION

This invention relates to a lifting and lowering apparatus, and more particularly to such an apparatus useful to persons experiencing difficulty in arising from bed.

Persons who had experienced debilitating diseases and confinement to bed are aware of the difficulties which can be posed by arising from the supine position lying abed to a standing position where muscles have been weakened, including the frustration of having limited strength and ability to control movement yet being dependent upon others for arising. It is frequently the case that persons weakened by such disease are capable of independent movement where aids to such movement are available.

It has been proposed heretofore to provide such aids for certain activities. Examples are found in Jenkins U.S. Pat. No. 1,349,674; Hassold U. S. Pat. No. 2,498,853; Upshaw U.S. Pat. No. 2,673,987; Steinemann U.S. Pat. No. 3,403,411; Pearce U.S. Pat. No. 3,914,806; and Love U. S. Pat. No. 4,587,678. Several of these prior disclosures retain the characteristic of requiring the attention of another person for moving a person to be aided. However, none address the specific problem of assisting a person in arising from a bed to a standing position or moving from a standing position to a position on a bed.

The present invention is directed specifically to the problem of assisting a person in arising from a bed to a standing position or moving from a standing position to a position on a bed.

BRIEF DESCRIPTION OF INVENTION

With the foregoing in mind, it is an object of this invention to assist a person in arising from a bed to a standing position while enabling the person being assisted to exercise control over the lifting procedure. In realizing this object of the invention, apparatus is provided which has a lifting platform supported for lifting and lowering movement and which permits such movement under the control of a user.

Yet a further object of the invention is to provide an apparatus of the type described in which a user of the apparatus is permitted to pivot their thighs and buttocks from a position of sitting on a lifting and lowering platform to a position of standing free from restraints otherwise possibly imposed by the apparatus. In realizing this object of the invention, a single apparatus is adapted to users of various heights and weights and the user is enabled to have control over an important portion of the movements necessary to arise from a bed to a standing position.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 3:
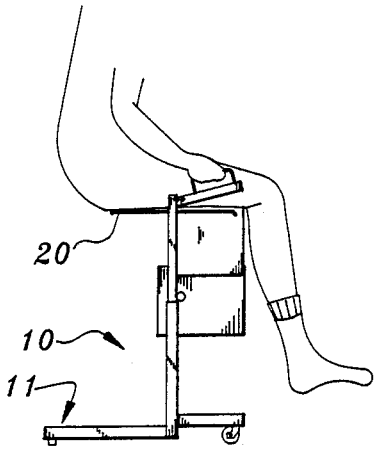
FIGS. 3 through 5 are a series of elevation views showing the progression of movements involved in a user of the apparatus of this invention moving from a bed to a standing position.
Figure 4:
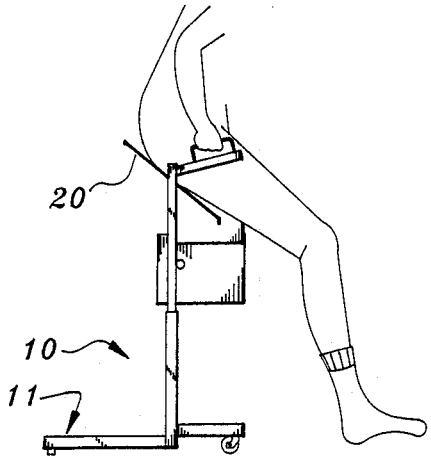
Figure 5:
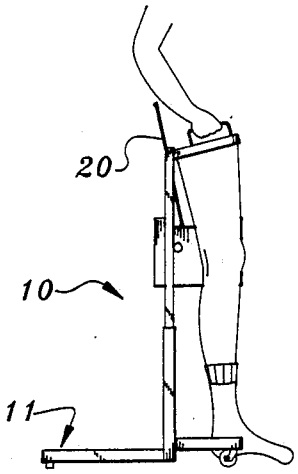

Referring now more particularly to the accompanying drawings, the series of views of FIGS. 3 through 5 show the apparatus of the present invention (generally indicated at 10) as used by a person arising from bed. The series of views will be referred to in sequence hereinafter when the use of the apparatus is more fully explained.

Figure 1:
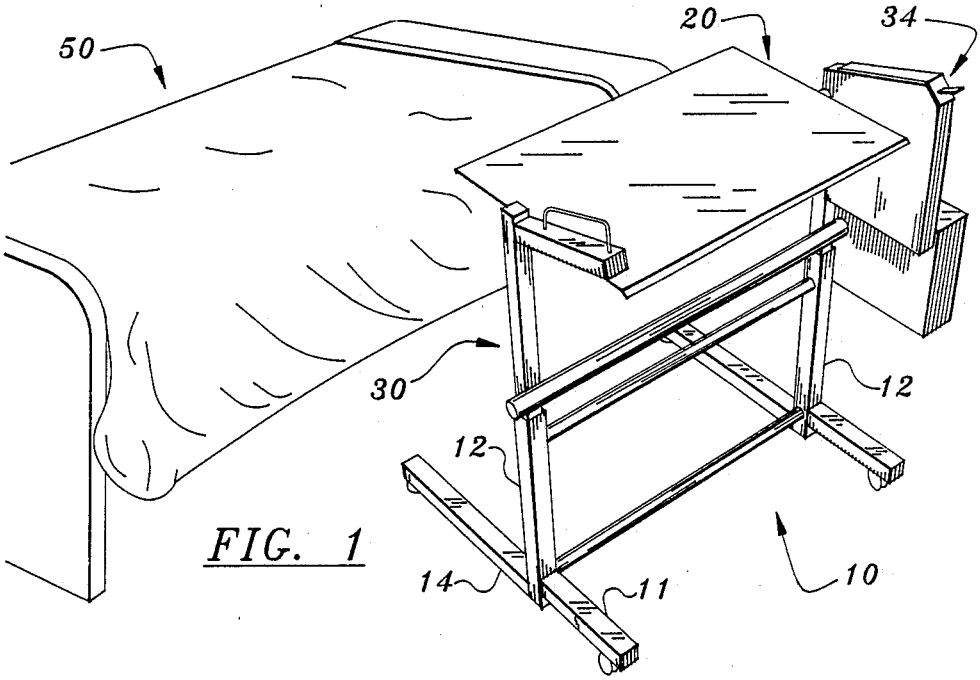
FIGS. 1 and 2 are perspective views showing the apparatus of this invention as viewed from first one side and then the other.
Figure 2:
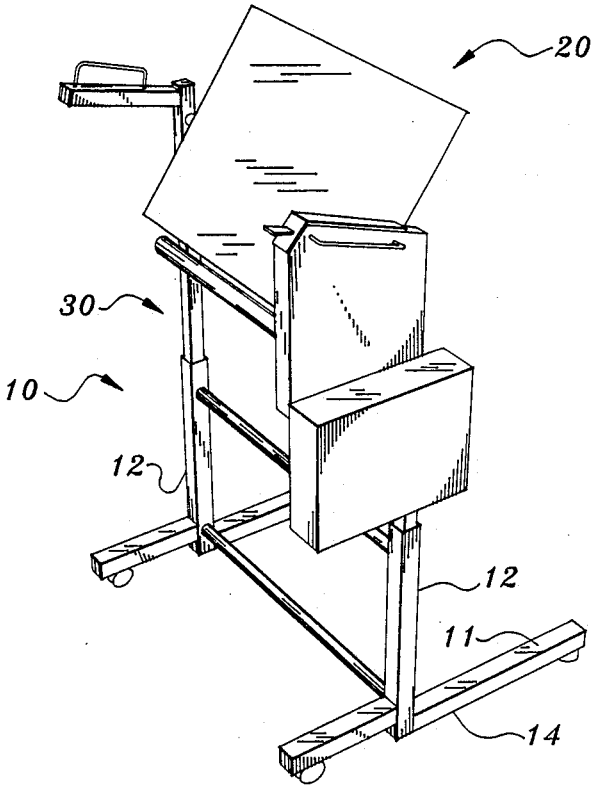

The apparatus 10 has a base frame means 11 for resting on a supporting surface such as a floor. The base frame 11 is shown as having a pair of upright members 12 and horizontal base members 14 which may rest on casters for ease of movement and be arranged for easily moving under a bed or the like (the bed being indicated at 50 in FIG. 1). The apparatus 10 also has person supporting platform means 20 for engaging the thighs and buttocks of a user of the apparatus, and means coupling the platform means 20 and the base frame means 11 for free rotation of the platform means 20 about a horizontal axis and for powered lifting and lowering of the platform means relative to the base frame means.

The platform means 20 preferably, as shown, comprises a generally planar member having a generally rectangular configuration with two sets of generally parallel side edges, with the horizontal axis about which the platform may pivot being located medially of one set of said side edges of said platform means. As will be understood, the platform means 20 preferably has one set of side edges which is longer than the other and the horizontal axis is located medially of the shorter set of side edges.

Figure 6:
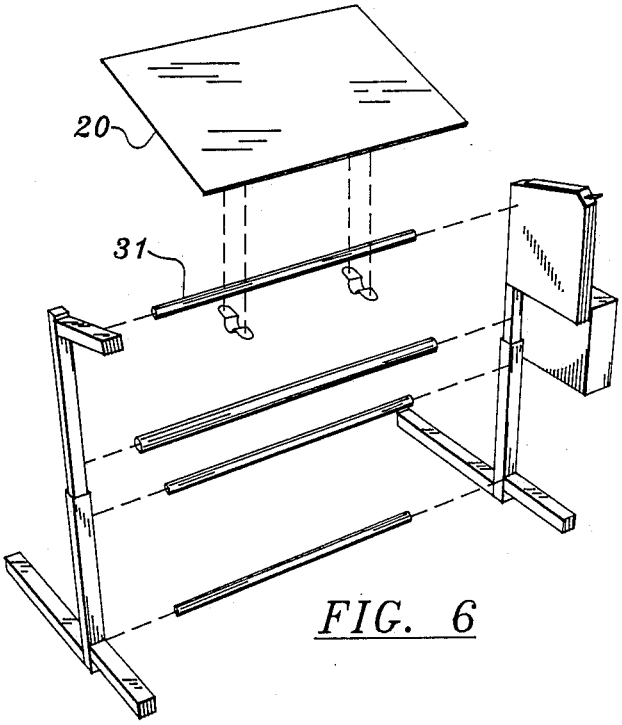
FIG. 6 is an exploded perspective view of the apparatus shown in use in FIGS. 1 through 3.
Figure 7:
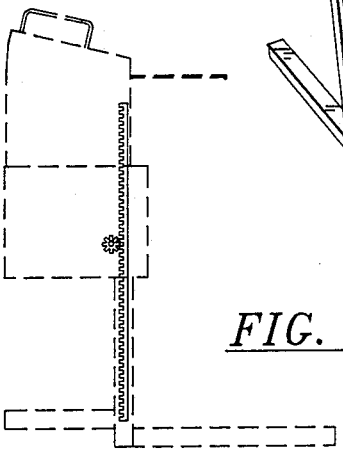
FIG. 7 is a partly phantom view showing the mechanism for lifting a portion of the apparatus of FIGS. 1 through 5.

The means which couples the lifting platform 20 to the base 11 includes a movable frame means 30 mounted on the base frame 11 for vertical movement relative thereto and having a horizontally disposed pivot member or bar 31 (FIG. 6) which defines the horizontal axis about which the platform 20 freely pivots. The coupling means further has motivating means, preferably in the form of an electrical motor, for driving the platform 20 in lifting and lowering movement relative to the base frame 11 and manually operable control means, preferably in the form of an appropriate electrical switch 34 (FIG. 1) electrically connected with the motor, operatively connected for enabling operation of the motivating means under the control of a person using the apparatus. The electrical motor is connected, by appropriate transmission means such as a rack and pinion gearing (FIG. 7), between the base frame 11 and the movable frame 30 for converting rotational motive power to lifting and lowering movement of the platform 20.

In use of the apparatus 10 (as shown in FIGS. 3 through 5), a person lying abed may sit up (FIG. 3) and then, with the lifting platform 20 moved to a position matching the height of the bed, swing their legs over the side of the bed and essentially horizontally onto the platform. The person thus assumes a position of being seated on the lifting platform 20 and immediately adjacent the bed. The user may then, by manipulating the switch 34, cause the electrical motor to drive the platform 20 in lifting motion while at the same time freely pivoting their lower body and torso into upright position and lowering their feet to the floor (moving progressively to the position of FIG. 4 and FIG. 5). The free rotation of the lifting platform 20 about the horizontal axis provides a push on the thighs and buttocks which facilitates the user coming to standing position without requiring the aid of another person (FIG. 5).

In the drawings and specifications there has been set forth a preferred embodiment of the invention and, although specific terms are used, the description thus given uses terminology in a generic and descriptive sense only and not for purposes of limitation.

What is claimed is:

1. An apparatus for assisting invalids in arising from bed and comprising:

base frame means for resting on a supporting surface such as a floor, person supporting platform means for engaging the thighs and buttocks of a user of the apparatus, and means coupling said platform means and said base frame means for non-rotatable free rotation of said platform means about a horizontal axis and for powered lifting and lowering of said platform means relative to said base frame means.

2. Apparatus according to claim 1 wherein said platform means comprises a generally planar member having a generally rectangular configuration with two sets of generally parallel side edges, and further wherein said horizontal axis is located medially of one set of said side edges of said platform means.

3. Apparatus according to claim 2 wherein one of said sets of side edges is longer than the other and further wherein said horizontal axis is located medially of the shorter set of side edges.

4. Apparatus according to claim 1 wherein said coupling means comprises movable frame means mounted on said base frame means for vertical movement relative thereto and having a horizontally disposed pivot member for defining said horizontal axis.

5. Apparatus according to claim 1 wherein said coupling means comprises motivating means for driving said platform means in lifting and lowering movement relative to said base frame means and manually operable control means operatively connected to said motivating means for enabling operation thereof under the control of an invalids using the apparatus.

6. Apparatus according to claim 5 wherein said motivating means comprises electrical motor means for selectively providing rotational motive power and transmission means operatively interconnecting said motor means and said base frame means for converting rotational motive power to lifting and lowering movement of said platform means.

7. An apparatus for assisting invalids in arising from bed and comprising:

base frame means for resting on a supporting surface such as a floor, movable frame means supported on said base frame means for movement vertically relative thereto, person supporting platform means supported on said movable frame means for vertical movement therewith, said platform means for engaging the thighs and buttocks of a user of the apparatus, pivot mounting means coupling said platform means and said movable frame means for non-rotatable free rotation of said platform means about a horizontal axis, and lifting means coupling said movable frame means and said base frame means for powered lifting and lowering of said movable frame means and said platform means relative to said base frame means.

8. Apparatus according to claim 7 wherein said platform means comprises a generally planar member having a generally rectangular configuration with two sets of generally parallel side edges, and further wherein said horizontal axis is located medially of one set of said side edges of said platform means.

9. Apparatus according to claim 8 wherein one of said sets of side edges is longer than the other and further wherein said horizontal axis is located medially of the shorter set of side edges.

10. Apparatus according to claim 7 wherein said lifting means comprises motivating means for driving said movable frame means in lifting and lowering movement relative to said base frame means and manually operable control means operatively connected to said motivating means for enabling operation thereof under the control of an invalid using the apparatus.

11. Apparatus according to claim 10 wherein said motivating means comprises electrical motor means for selectively providing rotational motive power and transmission means operatively interconnecting said motor means, said movable frame means and said base frame means for converting rotational motive power to lifting and lowering movement of said movable frame means.

12. An apparatus for assisting invalid in arising from bed and comprising:

base frame means for resting on a supporting surface such as a floor, movable frame means supported on said base frame means for movement vertically relative thereto, person supporting platform means supported on said movable frame means for vertical movement therewith, said platform means comprising a generally planar member having a generally rectangular configuration with two sets of generally parallel side edges for engaging the thighs and buttocks of a user of the apparatus, one of said sets of side edges being longer than the other, pivot mounting means coupling said platform means and said movable frame means for non-rotatable free rotation of said platform means about a horizontal axis disposed generally parallel to said longer set of side edges of said platform means and medially of said set of side edges which are shorter, and lifting means coupling said movable frame means and said base frame means for powered lifting and lowering of said movable frame means and said platform means relative to said base frame means, said lifting means comprising electrical motor means for selectively providing rotational motive power, transmission means operatively interconnecting said motor means, said movable frame means and said base frame means for converting rotational motive power to lifting and lowering movement of said movable frame means, and manually operable control means operatively connected to said electrical motor means for enabling operation thereof under the control of an invalid using the apparatus.

13. An apparatus for assisting invalids in arising from bed and comprising:

base frame means for resting on a supporting surface such as a floor, person-supporting platform means for engaging the thighs and buttocks of a user of the apparatus comprising a flat platform having no back so that when aligned with a top surface of a bed, said platform forms a continuation of the top surface of the bed, and means coupling said platform means and said base through a means for free rotation of said platform means about a horizontal axis and for powered lifting and lowering of said platform means relative to said base frame means.

14. An apparatus for assisting invalids in obtaining rest comprising:

a bed and a bed exit assist device including:

base frame means for resting on a supporting surface such as a floor adjacent said bed, invalid supporting platform means for engaging the thighs and buttocks of an invalid exiting a bed, and means coupling said platform means and said base frame means for free rotation of said platform means about a horizontal axis and for powered lifting and lowering of said platform means relative to said base frame means.

* * * * *